US007090625B2

(12) United States Patent
Chermack

(10) Patent No.: US 7,090,625 B2
(45) Date of Patent: Aug. 15, 2006

(54) DUMBBELL ADJUSTABLE IN WEIGHT

(76) Inventor: Darren Patrick Chermack, 9049 Pillsbury Ave. South, Bloomington, MN (US) 55420

( * ) Notice: Subject to any disclaimer, the term of this patent is extended or adjusted under 35 U.S.C. 154(b) by 407 days.

(21) Appl. No.: 10/655,112

(22) Filed: Sep. 4, 2003

(65) Prior Publication Data

US 2006/0025287 A1 Feb. 2, 2006

Related U.S. Application Data

(60) Provisional application No. 60/413,259, filed on Sep. 25, 2002.

(51) Int. Cl.
*A63B 21/72* (2006.01)

(52) U.S. Cl. ..... 482/108; 482/107

(58) Field of Classification Search ..... 482/92–94, 482/106–109; D21/681–682
See application file for complete search history.

(56) References Cited

U.S. PATENT DOCUMENTS

| | | | | |
|---|---|---|---|---|
| 850,964 | A * | 4/1907 | Pelletier et al. | 482/108 |
| 5,637,064 | A | 6/1997 | Olson et al. | |
| 5,769,762 | A | 6/1998 | Towley, III et al. | |
| 5,779,604 | A | 7/1998 | Towley, III et al. | |
| 5,839,997 | A | 11/1998 | Roth et al. | |
| 5,879,274 | A * | 3/1999 | Mattox | 482/107 |
| 5,971,899 | A | 10/1999 | Towley, III et al. | |
| 6,033,350 | A | 3/2000 | Krull | |
| D422,654 | S * | 4/2000 | Chen | D21/681 |
| 6,083,144 | A | 7/2000 | Towley, III et al. | |
| 6,149,558 | A * | 11/2000 | Chen | 482/107 |
| 6,186,928 | B1 | 2/2001 | Chen | |
| 6,196,952 | B1 | 3/2001 | Chen | |
| 6,228,003 | B1 | 5/2001 | Hald et al. | |
| 6,261,022 | B1 | 7/2001 | Dalebout et al. | |
| 6,500,101 | B1 | 12/2002 | Chen | |
| 6,540,650 | B1 * | 4/2003 | Krull | 482/107 |
| 6,656,093 | B1 * | 12/2003 | Chen | 482/108 |
| D498,272 | S * | 11/2004 | Sanford-Schwentke et al. | D21/681 |
| 6,899,661 | B1 * | 5/2005 | Krull | 482/107 |
| 2002/0128127 | A1 * | 9/2002 | Chen | 482/106 |
| 2003/0148862 | A1 * | 8/2003 | Chen et al. | 482/108 |
| 2004/0162198 | A1 * | 8/2004 | Towley et al. | 482/107 |
| 2004/0198569 | A1 * | 10/2004 | Sanford-Schwentke et al. | 482/108 |

* cited by examiner

*Primary Examiner*—Jerome Donnelly
*Assistant Examiner*—Victor K. Hwang

(57) ABSTRACT

An adjustable dumbbell featuring a handle containing an internal selection mechanism within series of nested weight units. The selection device is operated by a single action, in this case by turning a knob, which extends or retracts bars contained in the handle to attach a desired number of weight units to the handle.

20 Claims, 11 Drawing Sheets

DUMBBELL ADJUSTABLE IN WEIGHT

CROSS-REFERENCE TO RELATED APPLICATIONS

This application claims the benefit of U.S. Provisional Application No. 60/413,259, filed Sep. 25, 2002.

FIELD OF INVENTION

This invention relates to the exercise equipment field. It is focused toward free weights, utilizing weight-based resistance for exercise movements.

BACKGROUND OF THE INVENTION

Traditional dumbbells and barbells have been used for over a century for building body strength and continue to be used for general fitness, strength and endurance training, and physical rehabilitation.

There are two types of dumbbells: fixed and adjustable.

Fixed dumbbells are typically one solid piece of metal with a handle in the center. Fixed dumbbells present a problem for storage in limited space, being that usually two of each weight increment takes up a significant amount of room. Each set must also be purchased separately, making an entire set rather expensive. A set of fixed dumbbells is also not very portable, specifically moving the entire set is very inconvenient.

There are a variety of adjustable dumbbells designs, ranging from simple to very elaborate. Each of the existing designs has significant drawbacks. They stricken with one or more of the following problems: they take too much time to change weight, are not useable by someone with large hands, are unwieldy, are difficult to change weights, or pose a safety hazard.

The initial designs for adjustable dumbbells included individual disc-shaped weights with holes in the center that would slide onto a round bar and secured to the handle by means of some sort of locking collar. These collars might screw on, use a spring clamp, or have a collar with a threaded locking pin. If the collars are loose or loosen during use, they pose a safety hazard because the weights can fall off the handle.

Some innovative designs of adjustable dumbbells have appeared in the last decade. They use either an internal or external mechanism that attaches a desired number of weights to a handle. Although these designs show some promise, each has drawbacks and limitations.

These limitations include such elements as: external selection mechanisms which pose a safety hazard, mechanisms that are limited in their function, mechanisms that are overly complicated, mechanisms that prohibit general usefulness or user comfort, devices that would not be reliable or sturdy, or some combination of the above. Some concepts that the present devices uses are mentioned in previously submitted material, but are not put together to make a safe, versatile, durable and user-friendly mechanism. There is room among these innovations for further advancement in design and application.

The rack-and-pinion system is not a new technology. The present invention is unique in using not only the rack-and-pinion system, but combining it with a basic gear drive to extend the travel of the sliding elements, increasing the number of weights that the device may hold. This transmission system is also unique in that it further adds both safety and convenience of not having a users hand on the weight selection device during normal use.

The present invention utilizes specific design features that ensure proper function. Unlike previous devices, the present devices contains all of the following features: a rack-and-pinion device contained within the handle, a basic transmission for maximum travel of extendable elements, mechanisms for locking extendable elements in each incremental position, indicator of currently selected weight, and nested weight units that have bars attached to the sides of the plates for required support.

In summary, the present invention is the next generation of adjustable dumbbells, using both established concepts and new design features to create the simplest and safest adjustable dumbbell.

SUMMARY OF INVENTION

The primary objective of the present invention is to provide a compact and easy to use weight lifting system that is not hindered by clumsy design or functional limitations.

The present system involves a handle containing an internal rack-and-pinion mechanism within the grip for selectively attaching a desired number of weights to it. The present system also involves a series of nested weight units, each having two weight plates connected by bars along their outside edge. Each of these plates has holes for receiving the bars which extend from the handle to attach the weights to the handle.

The bars that extend from the handle do so simultaneously by way of the rack-and-pinion. The first bar is driven by a gear connected by a shaft to a knob on top of the handle. Turning the knob extends or retracts both bars into or out of the holes in the weight plates, attaching or separating them from the handle as desired.

Figure 1:
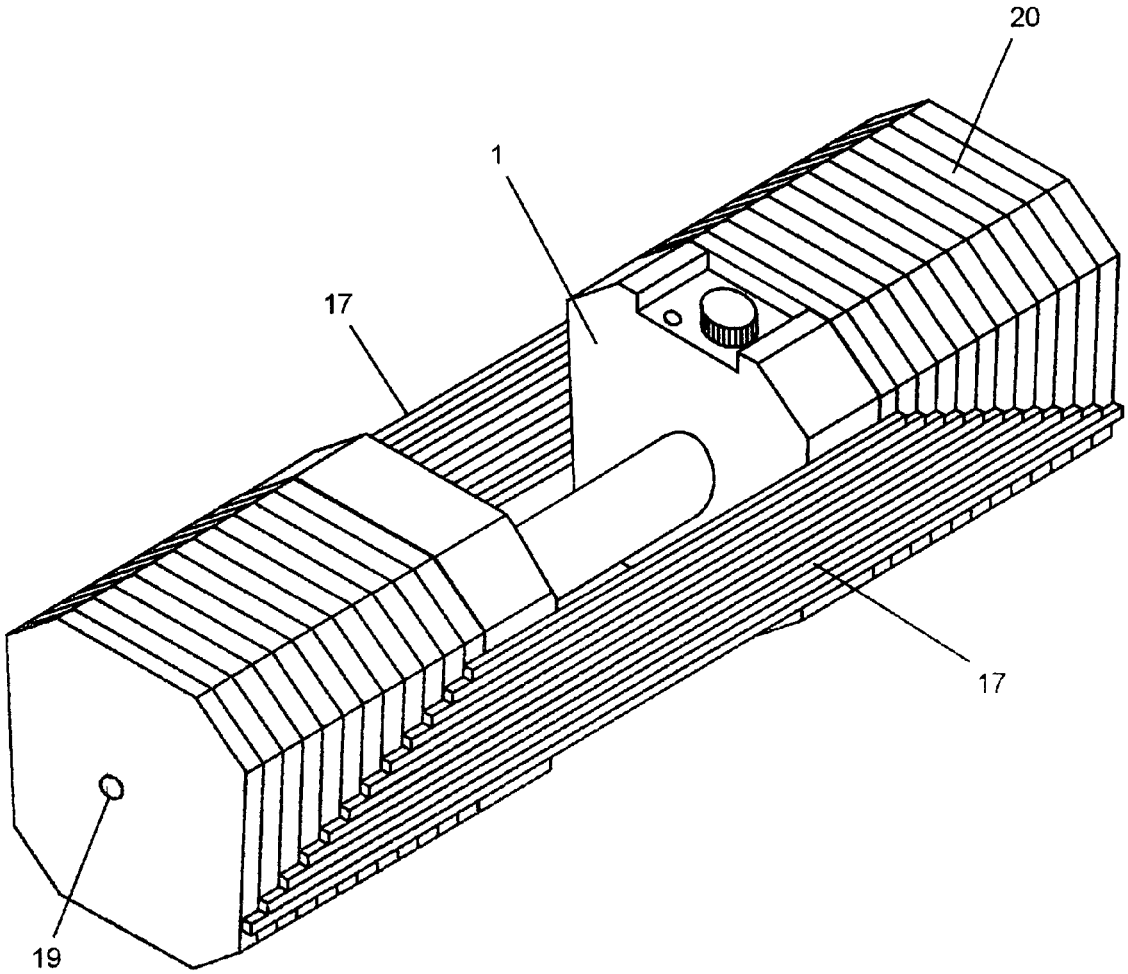
FIG. 1 shows a perspective view of the present invention.

While the above-identified drawings set forth one embodiment, other embodiments of the present invention are also contemplated. This disclosure presents illustrative embodiments of the present invention by way of representation and not limitation. Numerous other modifications and embodiments can be devised by those skilled in the art which fall within the scope and spirit of the principles of this invention. The drawing figures are not drawn to scale.

DETAILED DESCRIPTION OF THE INVENTION

Figure 2:
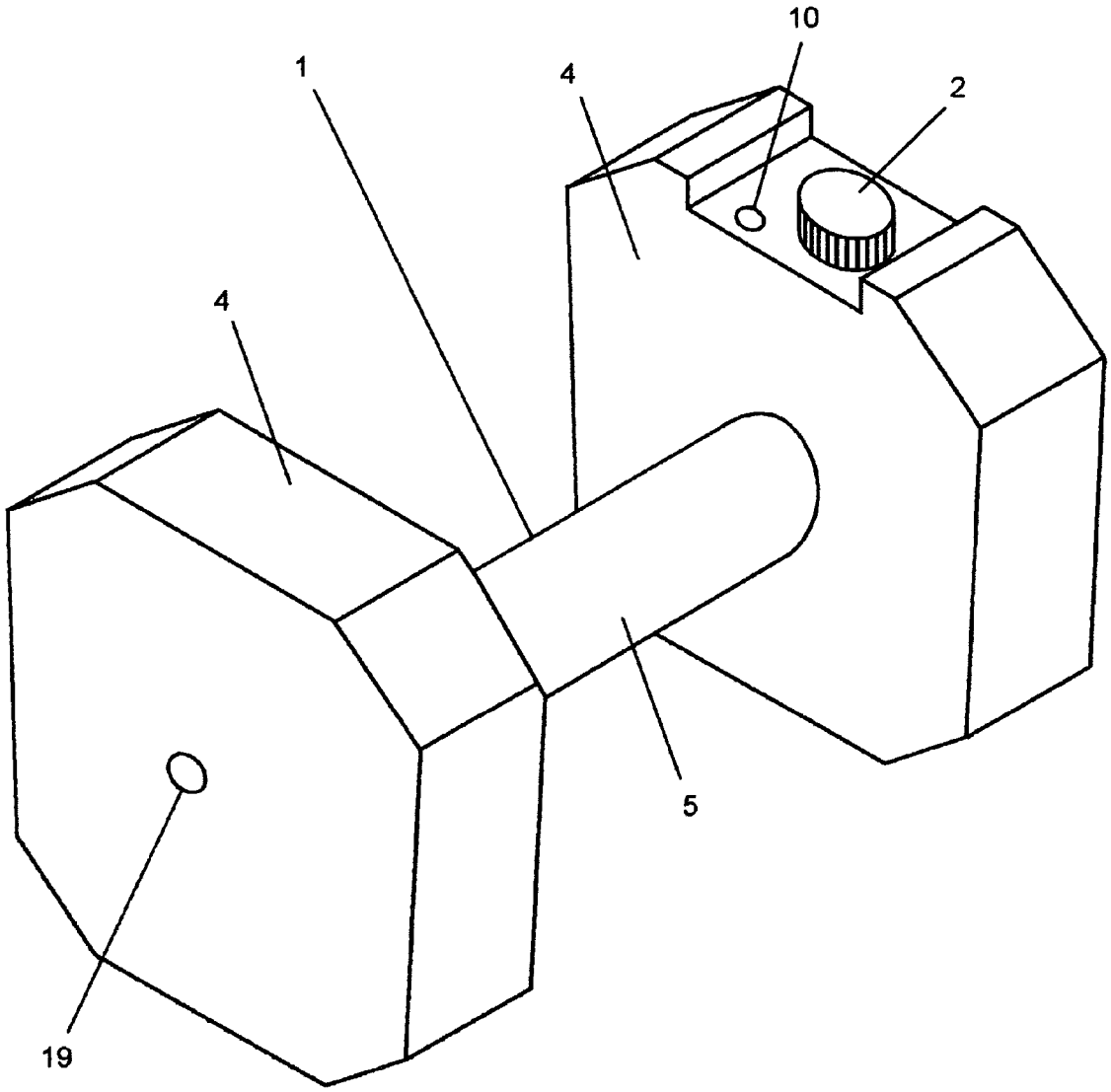
FIG. 2 shows a perspective view of the handle.

Component List:

1. Handle Unit
2. Selection Knob
3. Extending Rods
  3*a*. Teeth
4. Endpiece
5. Grip
6. Drive Gear
7. Center Gear
8. Drive Axle
9. Spring Plunger
  9*a*. Ball
  9*b*. Spring
10. Indicator Window
11. Indicator Dial
12. Dial Drive Gear
13. Dial Reduction Gear
14. Dial Indicator Gear
15. Weight Unit
16. Weight Plate
17. Bar
18. Channel
19. Holes
20. Weights
21. Dimples As shown in FIGS. 1–2, a dumbbell system of the present invention is shown, which comprises of (i) a handle unit 1, and (ii) a plurality of weights 20. The handle unit 1 consists of a grip 5 containing an internal mechanism for extending and retracting two extending rods 3, a selection device 2, two endpieces 4, and an indicator window 10 to display the currently selected weight.

Figure 3:
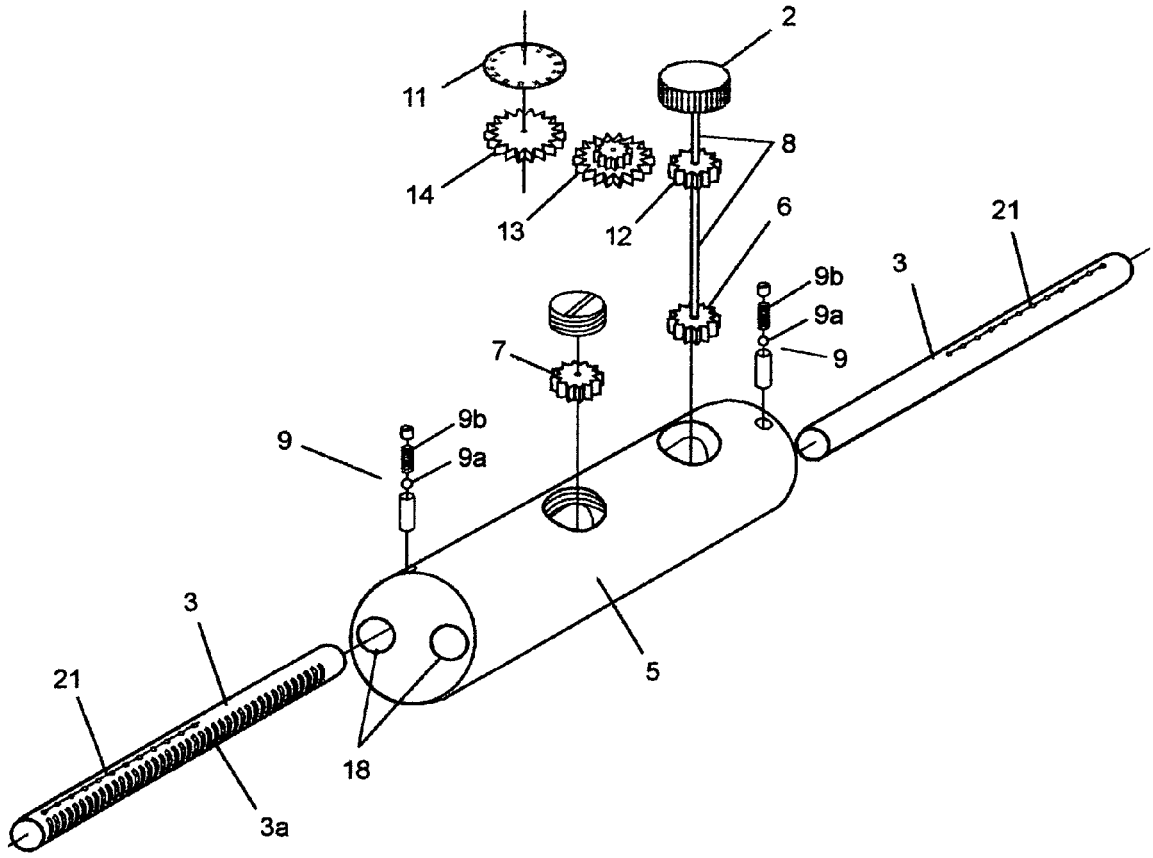
FIG. 3 shows an exploded view of the mechanism within the handle.
Figure 4:
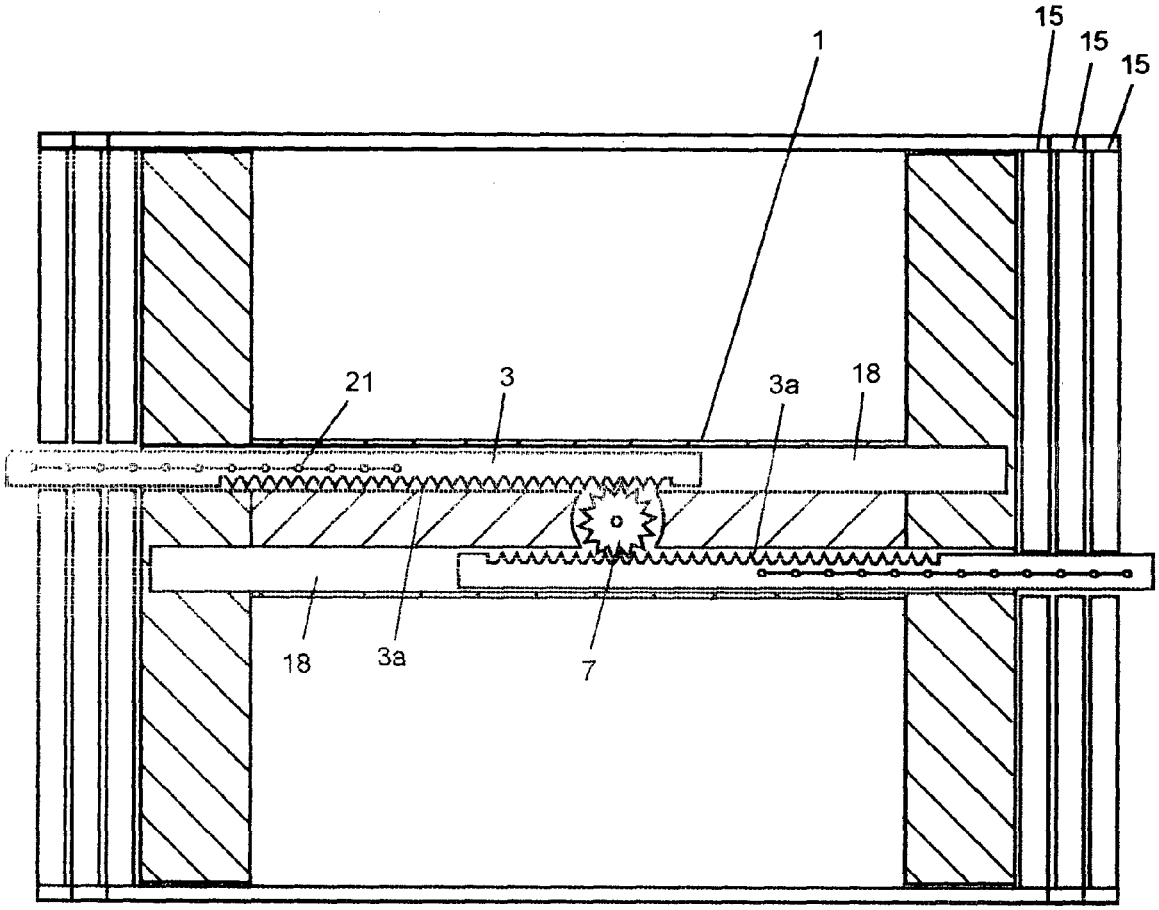
FIG. 4 shows a top cross-section view of the rack-and-pinion mechanism with the handle.

FIGS. 3–4 show the mechanism within the grip. The selection knob 2 turns the drive axle 8, which turns the main drive gear 6. The main drive gear 6 has gear teeth which engage rack teeth 3*a* the side of first extending rod 3. A center gear 7 is turned by the first extending rod 3 when the main drive gear 6 is turned. The center gear 7 then drives the second extending rod 3 in the direction opposite the first extending rod 3 an equal distance.

The handle unit 1 allows a user to turn the selection knob 2 to select how many weights 20 will be attached to the handle. The main drive gear 6 allows the extending bars 3 a range of travel up to half of their length.

The drive axle 8 has dial drive gear 12 attached to it. Dial drive gear 12 turns dial reduction gear 13, which in turn drives dial indicator gear 14. This transmission gives the dial indicator gear 14 the correct travel to display numbers on the attached indicator dial 11, visible through the indicator window 10 in the handle unit 1.

Figure 5:
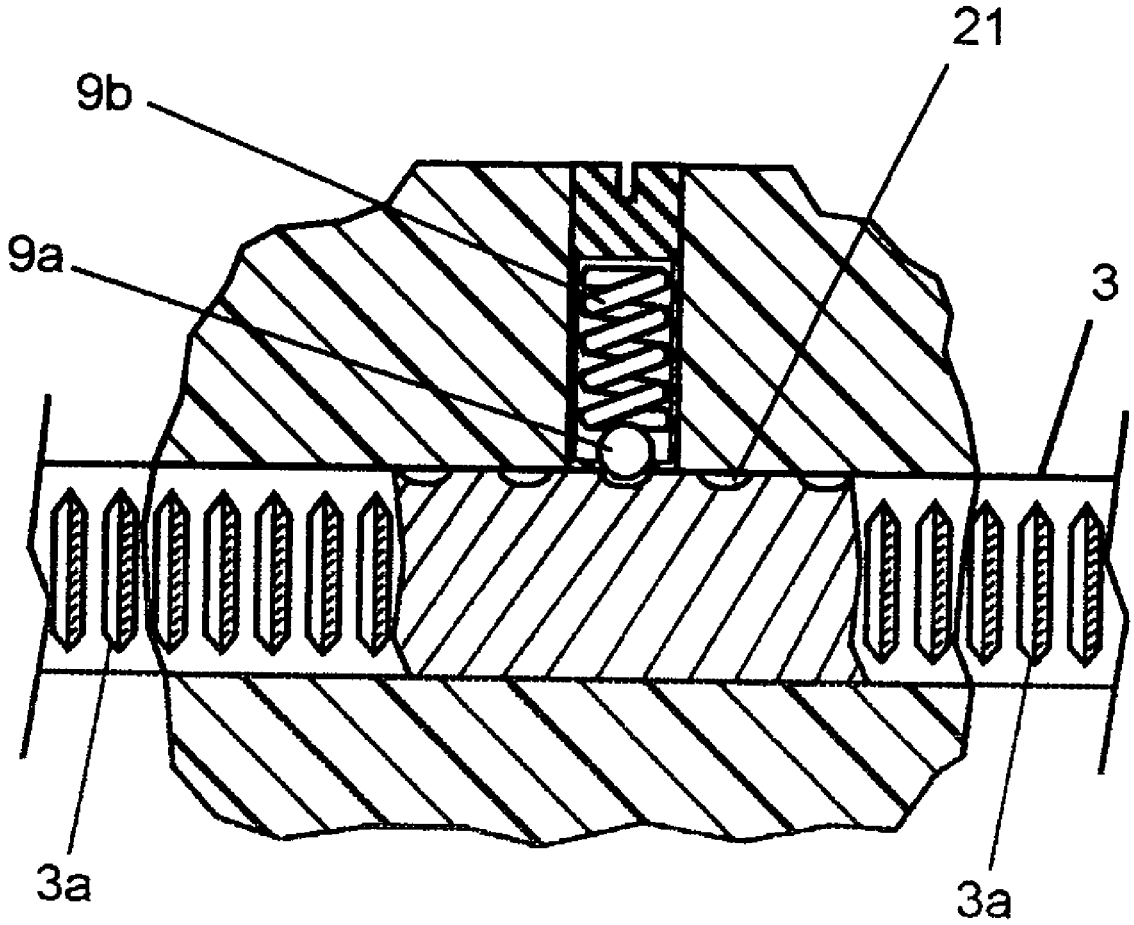
FIG. 5 shows a cross-section view of the ball plungers.

The grip 5 contains two spring plungers 9, which fit into a series of dimples 21 on either extending rod 3. These dimples 21 are positioned along the length of the extending rods 3 to snap the extending rods 3 into proper position for each weight unit 15 so that the extending rods 3 fill the holes 19 in the weight plates 16. FIG. 3 shows these spring plungers 9 in an exploded view. FIG. 5 shows a cutaway view of the spring plungers 9 and how they fit into the dimples 21 in the extending rod 3. Each spring plunger 9 has a ball 9*a* and a spring 9*b* which brings the ball 9*a* toward and into one of the dimples 21 on the extending rod 3.

Figure 9:
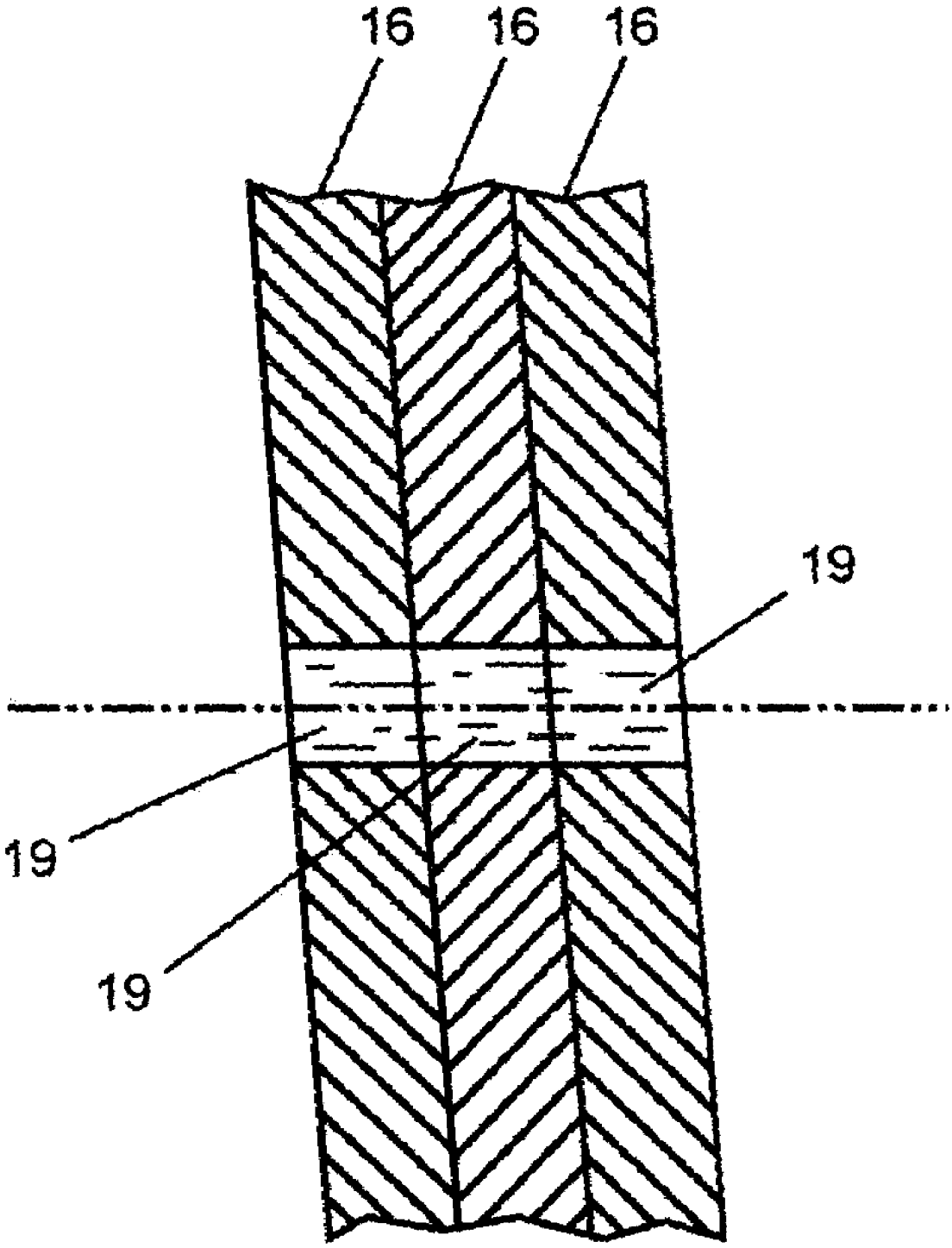
FIG. 9 shows a cross-section view of the holes through three consecutive weight units.
Figure 10:
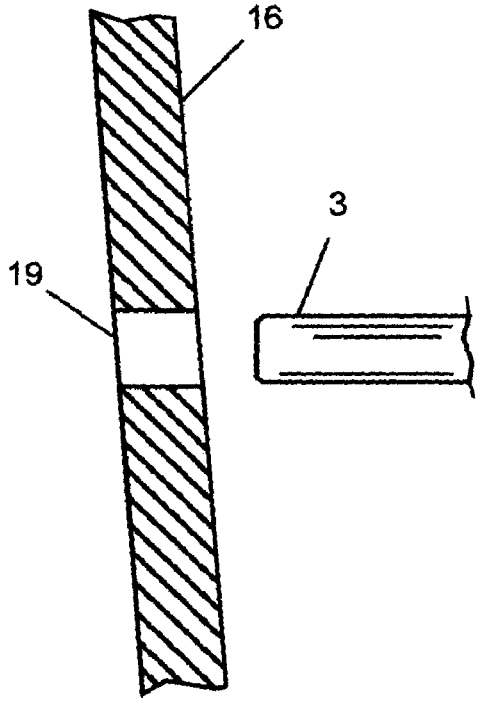
FIG. 10 shows a bar that has not penetrated the hole in the weight unit.
Figure 11:
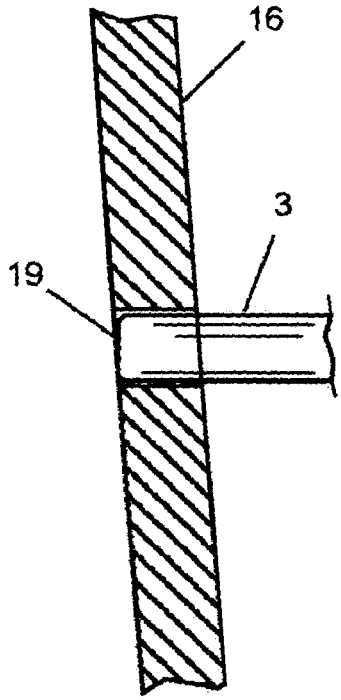
FIG. 11 shows a bar that has penetrated the hole in the weight unit.

FIG. 9 shows a sequence of three weight plates 16 with the holes 19 for accepting one of the extending rods 3. FIG. 10 shows the hole 19 in the weight plate 16 with the extending rod 3 not engaged. FIG. 11 shows the extending rod 3 inserted into the hole 19 of the weight plate 16. With the extending rod 3 in the hole 19, the weight unit 15 is attached to the handle unit 1.

Figure 6:
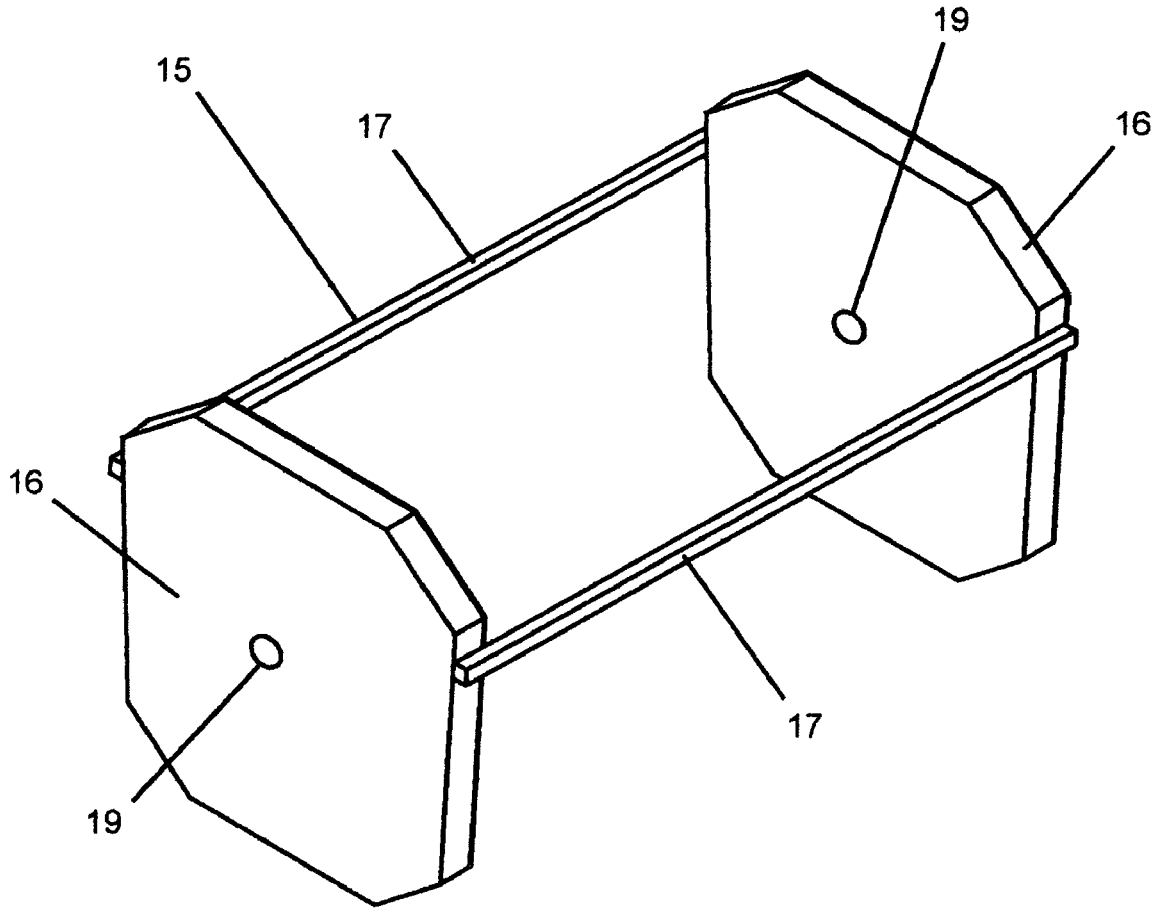
FIG. 6 shows a perspective view of a single weight unit.
Figure 8:
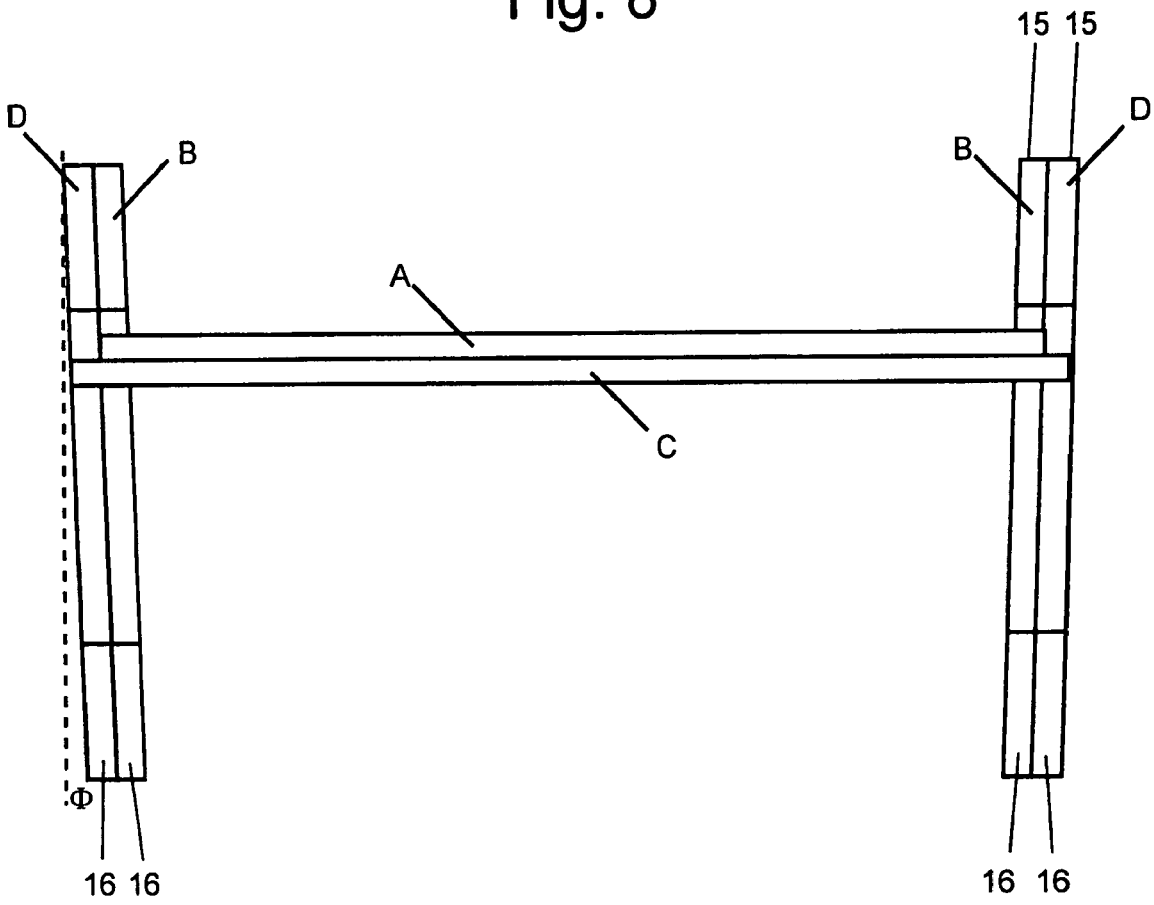
FIG. 8 shows the first two weight units nested one inside the other.

The weights 20 comprise of a series of nested weight units 15, with each weight unit 15 fitting inside the next larger weight unit 15. FIG. 6 shows one weight unit 15. FIG. 8 shows one weight unit 15 sitting within another weight unit 15. Each weight unit 15 is comprised of two weight plates 16 connected by at least one bar 17 along the outside perimeter. FIG. 8 shows a side view of how each weight unit 15 is configured. The inside weight unit 15 is made up of two weight plates 16 attached by the bar 17. The outside weight unit 15 is made up of two weight plates D attached by the bar 17.

Figure 7:
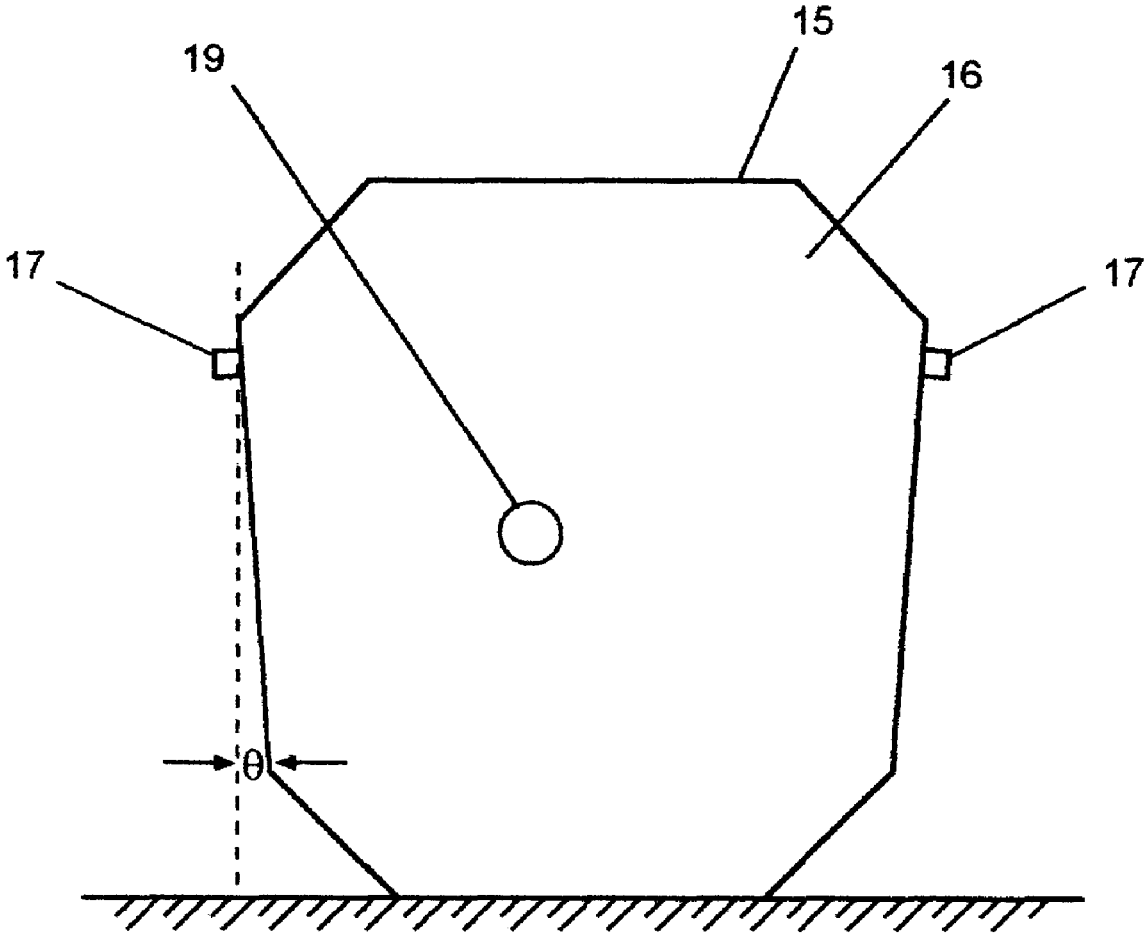
FIG. 7 shows an end view of a weight unit

Each weight unit 15 has two design features: (i) an angle θ, and (ii) an angle Φ. Angle θ is shown in FIG. 7 and provides easy replacement of the handle unit 1 and any weight units 15 attached to the handle unit 1. Angle Φ is shown in FIG. 8 also allows for the replacement listed above. Angle Φ may range from 1° to 5°.

Figure 12:
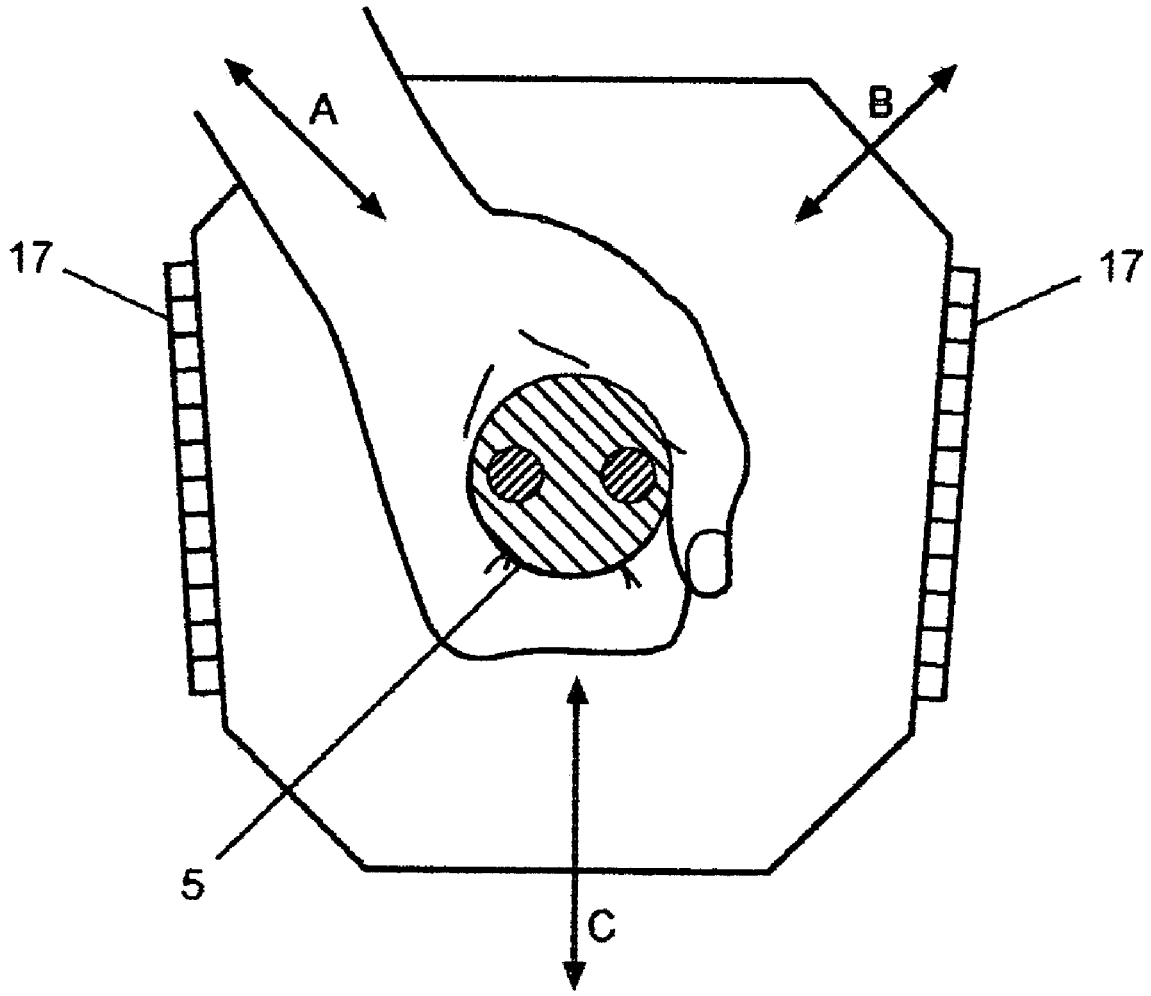
FIG. 12 shows a cutaway view of a handle being grasped by a hand.

FIG. 12 shows a cutaway end view of the present invention's mechanism and configuration. The present invention's configuration provides a large amount of space for a user's hand and wrist to grip the handle 5. There is enough room for a wrist to grasp the grip 5 from, for example, position A or B, or anywhere in between. There is even enough room for a user to place two hands on the grip 5. There is also room for a user to grasp the grip 5 from the bottom, i.e. position C, or both the top and bottom. There are no additional supports required for housing functional mechanisms.

Although the present invention has been described with reference to preferred embodiments, workers skilled in the art will recognize that changes may be made in form and detail without departing from the spirit and scope of the invention.

What is claimed is:

1. A weight lifting system comprising:

a) a weight unit comprising of a plurality of weights with each of said weights formed of a pair of upstanding plates and at least one bar, or similar connecting device, that connects each pair of plates;

b) a handle having opposing ends;

c) extendable elements which protrude from each end of the handle;

d) means for simultaneously extending and retracting the extendable elements to engage the weights, which include a means to allow travel to the full limit of the extendable elements;

e) a visual indicator indicating the amount of weight selected;

f) said handle comprises:

(i) a grip having two ends, (ii) each end having an endplate permanently attached, and (iii) a channel or channels in the grip in which the extendable elements may be extended from or retracted into;

wherein the grip has a gripping surface configured to be grasped by a user, the grip containing two channels therein, each channel housing one of said extendable elements, each said extendable element comprising a rod movably disposed within a respective channel of the grip;

wherein said means for simultaneously extending the extendable elements to engage the weight comprises means for selectively advancing the rods out of opposing ends of the grip such that the rods selectively pass through apertures in first and second ends of the weights, and the gripping surface having no obstruction to grasping by a user; and wherein said rods comprise first and second rods having teeth formed along a length thereof, the first rod moveable by a gear connected to a selection knob, the teeth of the first rod engaging a pinion gear, and the pinion gear engaging the teeth of the second rod to move the second rod.

2. A system as recited in claim 1, further comprising means for selectively advancing the rods in desired increments out of opposing ends of the handle, or retracting the rods in desired increments into the opposing ends of the handle by means of a gear or other reduction transmission.

3. A system as recited in claim 1, further comprising of incremental locks that stop the extendable elements at desired positions and limit their movement.

4. A system as recited in claim 1, comprising a weight stack comprising said plurality of weights, each weight comprising first and second upstanding weight plates connected by two bars, wherein the bars connect first and second weight plates on either side of the handle; wherein connecting bars couple the first upstanding plate and the second upstanding plate allowing the handle to rest within; wherein a relatively larger weight allows a relatively smaller weight to nest within it, and the handle to nest within the smallest weight; wherein a plurality of bars that connect the first and second weight plates of each weight are stacked one beneath the other, each being an integral part of the nested stack; and lending support of all bars above them when the handle is in use; and wherein each of the first and second weight plates has an aperture extending therethrough.

5. A system as recited in claim 4, wherein the ends of the handle have surfaces which are parallel to end surfaces of the weight.

6. A system as recited in claim 4, wherein the upstanding plates are angled away from each other slightly, making a top opening larger than the bottom.

7. A system as recited in claim 4, wherein the upstanding plates are shaped to include an angle on each side causing their edges to not be parallel with one another, as to allow the top width to be wider than the bottom.

8. A system as recited in claim 4, wherein the ends of a first weight have surfaces which mate with corresponding end surfaces of a second weight.

9. A weight lifting system as recited in claim 1, wherein there is adequate space to allow room for both hands on one handle while maintaining industry standard grip dimensions;

there is simplicity in operation simultaneously with traditional dumbbell shape and configuration; access to the handle from the bottom as easily as from the top; and means to restrict accidental movement of the extendable rods, making it unlikely for any weight to become disengaged from the handle mechanism unless user intervention commands it and the entire unit is safely sitting on a solid surface.

10. A weight lifting device comprising:

a handle unit comprising a pair of endplates with a grip therebetween;

said grip having a substantially obstruction free grip surface between said pair of endplates for grasping by a user, and at least one channel therein;

a pair of extendable rods moveable within said at least one channel of said grip;

each extendable rod having teeth along a portion thereof;

said handle unit further comprises a selection knob operatively connected to a drive gear, said drive gear engaging the teeth of a first one of said pair of extendable rods;

said teeth of said first extendable rod also engaging a pinion gear, said pinion gear engaging the teeth of a second one of said pair of said pair of extendable rods;

a plurality of weights, each weight comprising first and second weight plates joined by at least one connecting rod, and each weight plate having an aperture aligned with said at least one channel to selectively receive one of said pair of extendable rods, wherein said handle unit can be centrally positioned between said pairs of weight plates and rotation of the selection knob rotates the drive gear and moves the first extendable rod into or out of engagement with the first weight plates of a selected number of weights via the aperture in each respective first weight plate, and the movement of the first extendable rod rotates the pinion gear and moves the second extendable rod, in a direction opposite to movement of the first extendable rod, into or out of engagement with the second weight plates of the selected number of weights via the aperture in each respective second weight plate.

11. The weight lifting device of claim 10, wherein said at least one channel comprises first and second channels.

12. The weight lifting device of claim 10, wherein said selection knob is located on one of said pair of end plates of said handle unit.

13. The weight lifting device of claim 12, further comprising:

a drive axle mounted between said selection knob and said drive gear.

14. The weight lifting device of claim 13, further comprising:

a dial gear mounted on said drive axle between said selection knob and said drive gear; and an indicator dial operatively connected to said dial gear, wherein said indicator dial provides a user with an indication of the number of weights selected by the selection knob.

15. The weight lifting device of claim 14, further comprising:

a ball and dimple engagement to provide a selected positioning of said extendable rods.

16. The weight lifting device of claim 10, wherein said plurality of weights comprising nesting weights, wherein a relatively smaller weight is nested within a relatively larger weight and said handle unit is nested within a smallest one of said plurality of weights.

17. The weight lifting device of claim 16, wherein said at least one connecting rod comprises first and second connecting rods joining first and second weight plates of each respective weight.

18. The weight lifting device of claim 16, wherein said first and second weight plates of each respective weight have inner and outer surfaces, the inner and outer surfaces of the first weight plate being non-parallel to the inner and outer surfaces of the second weight plate, such that the first and second weight plates are angled toward one another from a top of the weight toward a bottom of the weight.

19. The weight lifting device of claim 16, wherein said first and second weight plates of each respective weight have side surfaces that are angled inwardly from a top of the weight to a bottom of the weight.

20. The weight lifting device of claim 10, further comprising:

a drive axle mounted between said selection knob and said drive gear;

a dial gear mounted on said drive axle between said selection knob and said drive gear;

a ball and dimple engagement to provide a selected positioning of said extendable rods;

an indicator dial operatively connected to said dial gear;

wherein said indicator dial provides a user with an indication of the number of weights selected by the selection knob; wherein said selection knob is located on one of said pair of end plates of said handle unit, and wherein said at least one channel comprises first and second channels;

wherein said plurality of weights comprise nesting weights, wherein a relatively smaller weight is nested within a relatively larger weight and said handle unit is nested within a smallest one of said plurality of weights;

wherein said at least one connecting rod comprises first and second connecting rods joining first and second weight plates of each respective weight;

wherein said first and second weight plates of each respective weight have inner and outer surfaces, the inner and outer surfaces of the first weight plate being non-parallel to the inner and outer surfaces of the second weight plate, such that the first and second weight plates are angled toward one another from a top of the weight toward a bottom of the weight; and wherein said first and second weight plates of each respective weight have side surfaces that are angled inwardly from the top of the weight to the bottom of the weight.

* * * * *